US005629673A

United States Patent [19]

Juhasz

[11] Patent Number: 5,629,673

[45] Date of Patent: May 13, 1997

[54] SHOOTING PATCH

[76] Inventor: Douglas Juhasz, 1513 Longley Ct., Sommerville, N.J. 08876

[21] Appl. No.: 654,077

[22] Filed: May 28, 1996

[51] Int. Cl.[6] ..... G08B 21/00

[52] U.S. Cl. ..... 340/540; 340/323 R; 340/573; 340/665; 340/686; 2/94

[58] Field of Search ..... 340/540, 573, 340/665, 693, 323 R, 686; 2/94, 267

[56] References Cited

U.S. PATENT DOCUMENTS

| | | | |
|---|---|---|---|
| 4,243,165 | 1/1981 | Schuler | 2/94 |
| 4,455,684 | 6/1984 | Johnson | 2/2 |
| 4,610,034 | 9/1986 | Johnson | 2/94 |
| 4,643,815 | 2/1987 | Allen | 2/94 |
| 4,669,125 | 6/1987 | Allen | 2/94 |
| 4,824,107 | 4/1989 | French | 273/1 GC |
| 5,014,358 | 5/1991 | Matumori | 2/94 |
| 5,057,819 | 10/1991 | Valenti | 340/573 |
| 5,113,176 | 5/1992 | Harris | 340/573 |
| 5,144,705 | 9/1992 | Rogers | 5/453 |
| 5,471,861 | 12/1995 | Kirii | 72/351 |
| 5,500,635 | 3/1996 | Mott | 340/323 R |

*Primary Examiner*—Brent A. Swarthout
*Assistant Examiner*—Van T. Trieu

[57] ABSTRACT

A device positions the butt end of a firearm. The device functions to assist the user in properly positioning and aiming the firearm. In its broadest context, the present invention includes a cushioning member adapted to be worn approximate the shoulder of the user and a positioning device. This positioning device includes a pressure sensor, a microprocessor and a sounding element. The sounding element gives the user an audible signal when a predetermined amount and distribution of pressure have been applied to the sensor.

4 Claims, 3 Drawing Sheets

SHOOTING PATCH

BACKGROUND OF THE INVENTION

1. Field of the Invention

The present invention relates to a new and improved shooting patch and, more particularly, pertains to assisting a user to determine when he or she is properly positioning and aiming a firearm.

2. Description of the Prior Art

The use of re-coil pads for firearms is known in the prior art. More specifically, re-coil pads for firearms heretofore devised and utilized for the purpose of positioning the butt end of a firearm are known to consist basically of familiar, expected, and obvious structural configurations, notwithstanding the myriad of designs encompassed by the crowded prior art which has been developed for the fulfillment of countless objectives and requirements.

The prior art discloses a large number of devices for assisting a user in absorbing recoil from a firearm. By way of example, U.S. Pat. No. 4,982,521 to Sutton; U.S. Pat. No. 4,887,374 to Santarossa and U.S. Pat. No. 5,265,366 to Thompson all disclose shock-relieving pads for firearms. Furthermore, U.S. Pat. No. 3,514,889 to Pachmayr; U.S. Pat. No. 5,014,358 to Matumori and U.S. Pat. No. 4,669,125 to Allen each disclose pads which are employed in reducing firearm recoil. Lastly, U.S. Pat. No. 3,866,241 to Grant illustrates a shoulder pad cushion.

In this respect, the shooting patch according to the present invention substantially departs from the conventional concepts and designs of the prior art, and in doing so provides an apparatus primarily developed for the purpose of assisting a user to determine when he or she is properly positioning and aiming a firearm, while also reducing recoil.

Therefore, it can be appreciated that there exists a continuing need for a new and improved shooting patch which can be used for assisting a user to determine when he or she is properly positioning and aiming a firearm. In this regard, the present invention substantially fulfills this need.

SUMMARY OF THE INVENTION

In view of the foregoing disadvantages inherent in the known types of re-coil pads for firearms now present in the prior art, the present invention provides an improved shooting patch. As such, the general purpose of the present invention, which will be described subsequently in greater detail, is to provide a new and improved shooting patch and methods which have all the advantages of the prior art and none of the disadvantages.

To attain this, the present invention essentially comprises a device for positioning the butt end of a firearm, the device functioning to assist the user in properly positioning and aiming the firearm. The device includes a rectangular cushioning member having a front face and a rear face and a peripheral extent and an interior area. A plurality of eyelets are formed within the peripheral extent of the cushioning member. Furthermore, a pressure sensor is centrally disposed within the interior region of the cushioning member. This pressure sensor functions to sense pressures applied to the front face of the cushioning member. Furthermore, a microprocessor is associated with the pressure sensor and functions to calculate the amount and distribution of pressure applied to the sensor. Additionally, a sounding means is associated with the microprocessor and functions to produce an audio signal when the microprocessor determines that a predetermined amount and distribution of pressure have been applied to the sensor. Clothing, which is adapted to be worn by the user of the device, has the rear face of the cushioning member secured to one of its two shoulder regions. This securement can be achieved by way of filaments threaded through both the eyelets of the cushioning member and the material of the clothing.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved shooting patch which has all the advantages of the prior art re-,coil pads for firearms and none of the disadvantages.

It is another object of the present invention to provide a new and improved shooting patch which may be easily and efficiently manufactured and marketed.

It is a further object of the present invention to provide a new and improved shooting patch which is of a durable and reliable construction.

An even further object of the present invention is to provide a new and improved shooting patch which is susceptible of a low cost of manufacture with regard to both materials and labor, and which accordingly is then susceptible of low prices of sale to the consuming public, thereby making such re-coil pads for firearms economically available to the buying public.

Still yet another object of the present invention is to provide a new and improved shooting patch which provides in the apparatuses and methods of the prior art some of the advantages thereof, while simultaneously overcoming some of the disadvantages normally associated therewith.

Even still another object of the present invention is to assist a user to determine when he or she is properly positioning and aiming a firearm.

Lastly, it is an object of the present invention to provide a device for positioning the butt end of a firearm. The device functions to assist the user in properly positioning and aiming the firearm. In its broadest context, the present invention includes a cushioning member adapted to be worn approximate the shoulder of the user and a positioning means. This positioning means includes a pressure sensor, a microprocessor and a sounding means. The sounding means gives the user an audible signal when a predetermined amount and distribution of pressure have been applied to the sensor.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
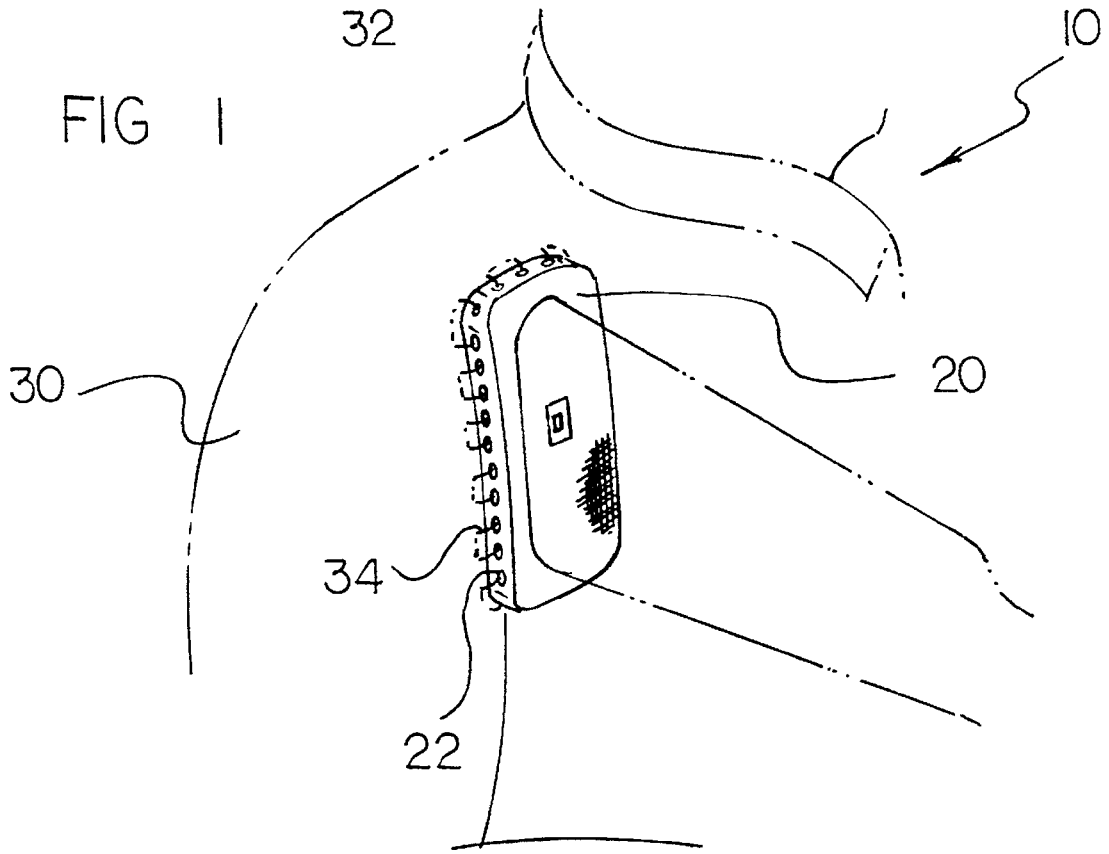
FIG. 1 is a perspective view of the shooter's pad constructed in accordance with the principles of the present invention.
Figure 2:
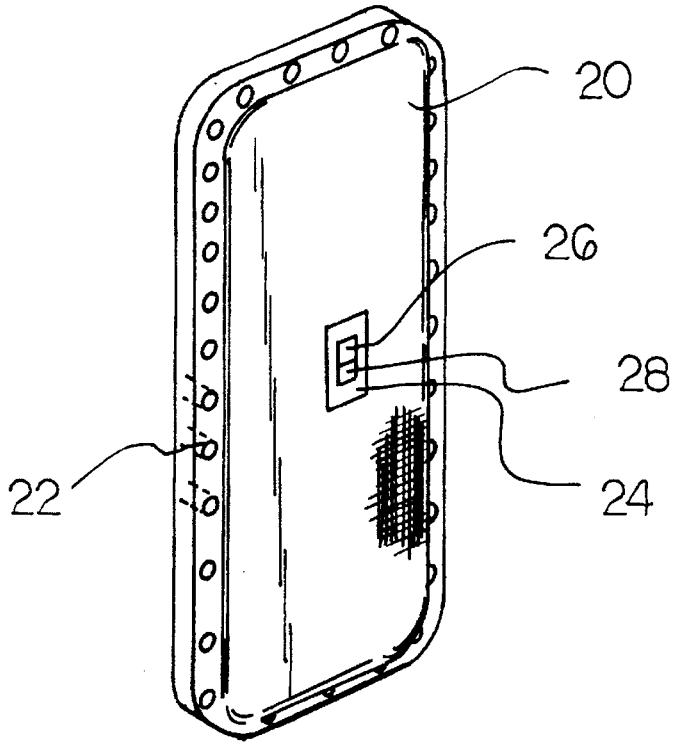
FIG. 2 is a view of the present invention removed from the clothing of a user.
Figure 3:
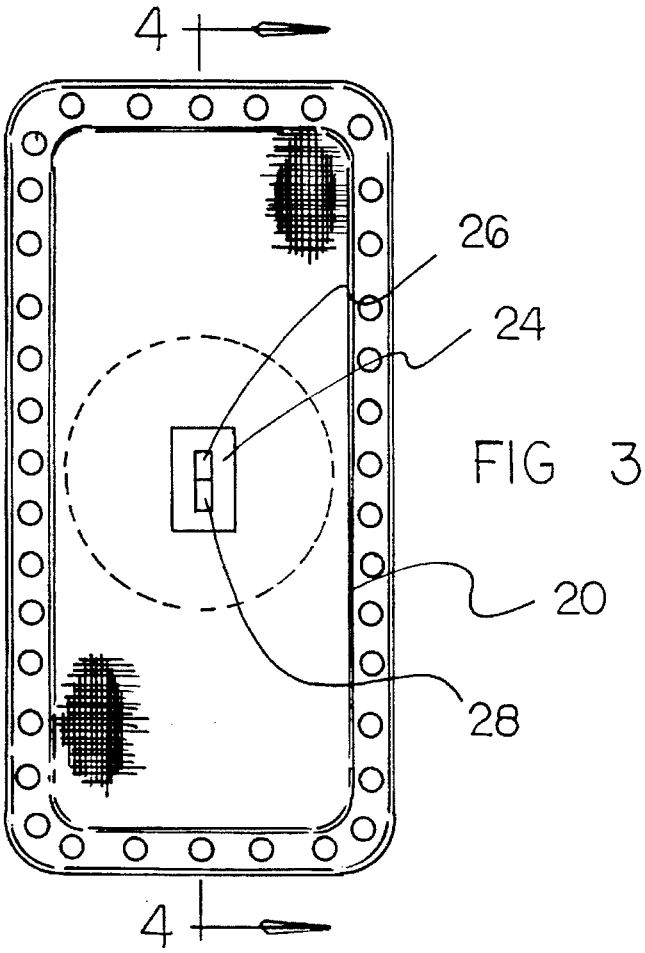
FIG. 3 is a front view of the preferred embodiment of the present invention.
Figure 4:
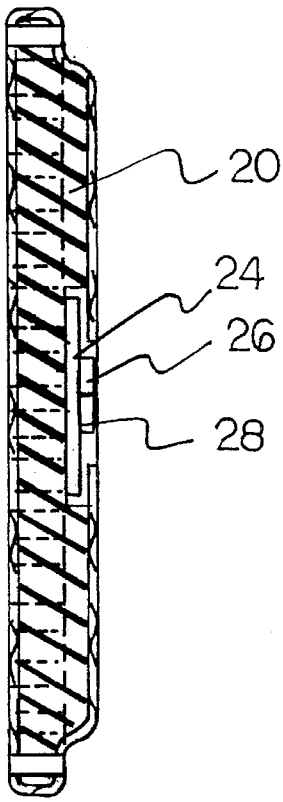
FIG. 4 is a view taken along line 4—4 of FIG. 3.
Figure 5:
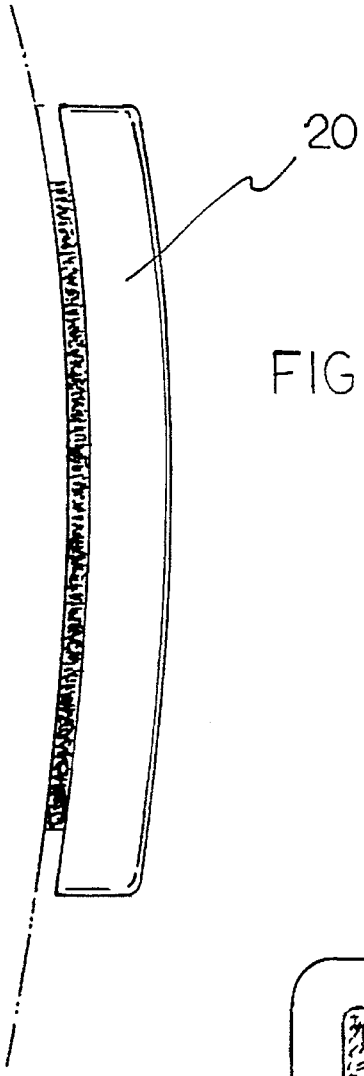
FIG. 5 is a side view of the device employing a pile-type attachment means.
Figure 6:
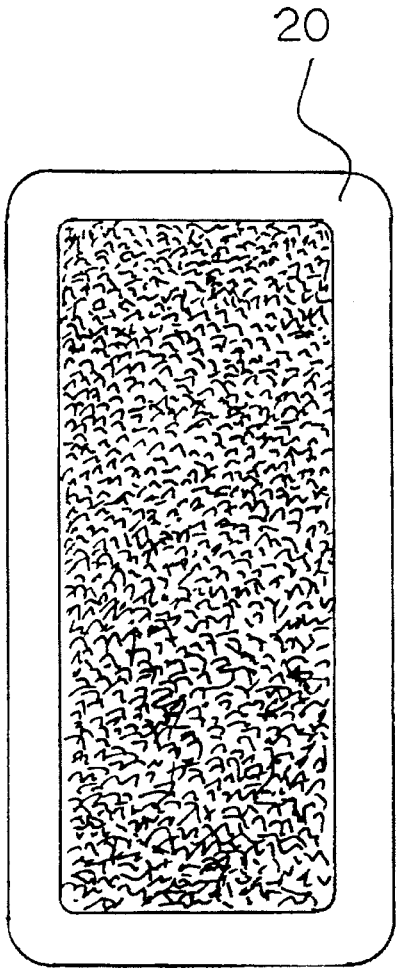
FIG. 6 is a plan view of the device employing a pile-type fastening means.

With reference now to the drawings, and in particular to FIG. 1 thereof, the preferred embodiment of the new and improved shooting patch embodying the principles and concepts of the present invention and generally designated by the reference numeral 10 will be described.

The present invention relates to a device for use in positioning or supporting the butt end of a firearm or rifle. The device functions to assist the user in properly positioning and aiming the firearm. In its broadest context, the present invention includes a cushioning member which is adapted to be affixed to the shoulder region of the user's clothing or shirt, a pressure sensor, microprocessor and sounding means all positioned within the cushioning member. The pressure sensor, microprocessor and sounding means together constitute a system for use in assisting the user in determining if the firearm is properly positioned. The various components of the present invention, and the manner in which they interrelate, will be described in greater detail hereinafter.

In the preferred embodiment, the cushioning member 20 is rectangular in shape and defined by a front face, a rear face, a peripheral extent and an interior region. Furthermore, in the preferred embodiment the cushioning member is constructed from a rubber material to afford the cushioning member a sufficient degree of resilience to absorb any kick-backs resulting from firing the firearm. Additionally, the cushion member can be encased in a cloth material to provide the member a textured surface for assisting the positioning of the butt end of the firearm and to increase its aesthetic appearance. A plurality of eyelets 22 are formed within the peripheral extent of the cushioning member 20. The function of these eyelets will be described in greater detail hereinafter.

A positioning means is located within the interior area of the cushioning member. This positioning means comprises a pressure sensor 24, a microprocessor 26 and a sounding means 28. The pressure sensor 24 functions to sense pressures applied to the front face of the cushioning member. The microprocessor 26 which is associated with the pressure sensor functions to calculate the amount and distribution of this pressure. Additionally, the sounding means 28 associated with both the microprocessor and the pressure sensor functions to produce an audio signal when the microprocessor 26 determines that a predetermined amount and distribution of pressure have been applied to the sensor 24. A rectangular opening is formed within the central area of the front face of the cushioning member to aid in the placement of the positioning system. Thus the pressure sensor 24, microprocessor 26 and sounding means 28 are secured within a recess formed within the cushioning member. Specifically, the positioning of the pressure sensor is critical in that it is employed in determining the proper positioning of the butt end of the firearm. Thus, as indicated previously, the pressure sensor is centrally disposed within the cushioning member.

The above described cushioning member with its associated positioning means is adapted to be affixed to the clothing of a user employing the device of the present invention. This clothing 30 is partially defined by two shoulder regions 32. The rear face of the cushioning member 20 is adapted to be fixed upon one of the shoulder regions 32 of the clothing 30. This securement can take place by way of a filament 34 secured through both the eyelets 22 and the material of the clothing 30.

Thus, what has been described is a cushioning member which is adapted to be affixed to one of the shoulder regions of a clothing. The cushioning member can be secured to either of the shoulder regions depending upon the preference of the user. In the preferred embodiment, this securement takes place by way of filament 34 and eyelets 22. However, other securing means can be employed such as hook and pile fasteners. A positioning means is centrally disposed within the cushioning member. This positioning means functions to determine the amount and distribution of pressure applied by the butt end of the firearm. If a proper amount and distribution of pressure are sensed by the positioning system the user will be notified by way of an audio signal. However, if the butt end of the firearm is out of position, the sensor will not detect the predetermined amount and distribution of pressure. Consequently, the use will not hear an audio signal. In this manner, the present invention aids a user to precisely orient the butt end of a firearm upon his or her shoulder.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A device for positioning the butt end of a firearm, the device functioning to assist the user in properly positioning and aiming the firearm, the device comprising, in combination:

a rectangular cushioning member having a front face, a rear face, a peripheral extent and an interior region, a plurality of eyelets formed within the peripheral extent;

a pressure sensor centrally disposed within the interior region of the cushioning member, the pressure sensor functioning to sense pressures applied to the front face of the cushioning member, a microprocessor associated with the pressure sensor functioning to calculate the amount and distribution of pressure applied to the pressure sensor, sounding means associated with the microprocessor functioning to produce an audio signal when the microprocessor determines that a predetermined amount and distribution of pressure have been applied to the sensor; and clothing to be worn by the user of the device, the shirt having two shoulder regions, the rear face of the cushioning member being affixed to one of the shoulder regions by way of the eyelets, a filament interconnecting the eyelets of the cushioning member to one of the shoulder regions of the shirt.

2. A device for positioning the butt end of a firearm, the device functioning to assist the user in properly positioning and aiming the firearm, the device comprising:

a cushioning member having a front face, a rear face, a peripheral extent and an interior region; and a pressure sensor centrally disposed within the interior region of the cushioning member, the pressure sensor functioning to sense pressures applied to the front face of the cushioning member by the butt end of a firearm, a microprocessor associated with the pressure sensor functioning to calculate the amount and distribution of pressure applied to the pressure sensor, sounding means associated with the microprocessor functioning to produce an audio signal when the microprocessor determines that a predetermined amount and distribution of pressure have been applied to the sensor.

3. The device as described in claim 2 and further comprising:

a plurality of eyelets formed within the peripheral extent of the cushioning member, the eyelets for use in securing the cushioning member to a shirt of the user.

4. The device as described in claim 2 wherein:

the cushioning member is rectangular in shape.

* * * * *